United States Patent [19]

Logan

[11] 4,096,668

[45] Jun. 27, 1978

[54] ENDLESS BELT SANDING TOOL

[76] Inventor: Raymond D. Logan, 10525 Bethesda Church Rd., Damascus, Md. 20750

[21] Appl. No.: 758,821

[22] Filed: Jan. 12, 1977

[51] Int. Cl.[2] ..... B24B 23/06

[52] U.S. Cl. ..... 51/170 EB; 51/135 R; 51/359

[58] Field of Search ..... 51/170 EB, 134.5 R, 51/135 R, 359

[56] References Cited

U.S. PATENT DOCUMENTS

| | | | |
|---|---|---|---|
| 1,707,584 | 4/1929 | Swan | 51/170 EB |
| 2,060,266 | 11/1936 | Thompson | 51/170 EB |
| 2,279,782 | 4/1942 | Fowler | 51/170 EB |
| 2,289,481 | 7/1942 | Burleigh | 51/170 EB |
| 2,819,565 | 1/1958 | Werth | 51/170 EB |
| 2,840,959 | 7/1958 | Pritikin | 51/359 |

FOREIGN PATENT DOCUMENTS

| | | | |
|---|---|---|---|
| 740,835 | 10/1943 | Germany | 51/170 EB |

*Primary Examiner*—James L. Jones, Jr.

*Assistant Examiner*—Roscoe V. Parker

*Attorney, Agent, or Firm*—Ulle C. Linton

[57] ABSTRACT

In an endless belt sanding tool, drive is imparted to the endless belt by a drive roller contacting the outer sanded face of the belt at a part thereof intermediate two thrust rollers. The tool may have an integral motor, or be adapted for drive from an external source such as an electric drill. A preferred embodiment has the belt and its support and thrust means on a portion of a tool body which is separable from the remainder of the tool body carrying the driving roller. Step adjustment or spring-loading may be provided to tension the belt. A speed-change is advantageously included in coupling means to the drive roller. The body may include an extension pivotable with respect to the remainder, for positioning the belt in a non-linear path. The body may include a resilient backing plate for the belt. A plurality of discrete belts may be arranged in a bunch, with provision for maintaining tension in the remainder whenever a worn belt is removed.

10 Claims, 16 Drawing Figures

ENDLESS BELT SANDING TOOL

This invention relates to an endless belt sanding tool, and especially to a hand tool of the kind wherein an endless loop of sanding paper or cloth passes about end rollers with its sanding face at the exterior of the loop.

BACKGROUND OF THE INVENTION

Hitherto, endless belt sanding tools, of the kind wherein the belt passes and returns about end rollers, have conventionally imparted drive to the belt by applying motor drive to one of the end rollers, or to another roller positioned within the endless loop of the belt. It has not been proposed before to apply the drive externally to the endless belt, for example to take advantage of the highly frictional nature of its sanding surface.

OBJECTS OF THE INVENTION

The primary object of the invention is to provide an improved construction of endless belt sanding tool wherein drive is imparted to the endless belt by a drive roller contacting the outer sanded face of the belt, thereby permitting the drive means to be wholly external to the belt, and thus facilitating changing of the belt, e.g., by having the tool in two separable portions, one of which carries the belt and the other of which carries the drive means.

SUMMARY OF THE INVENTION

An endless belt sanding tool comprises a body, support means at spaced positions on the body, two thrust means at spaced positions on the body, an endless sanding belt engaged for returning about said support means and engaged over said thrust means, and a driving roller journalled for rotation on the body and positioned to be contacted over an arc by the external face of a run of the belt intermediate the positions where that run of the belt is engaged over the thrust means.

Other features, objects and advantages of the invention will be apparent from the following description of presently preferred embodiments, given for disclosure and by way of non-limiting example with reference to the figures of the accompanying drawings.

DESCRIPTION OF THE PREFERRED EMBODIMENTS

Figure 1:
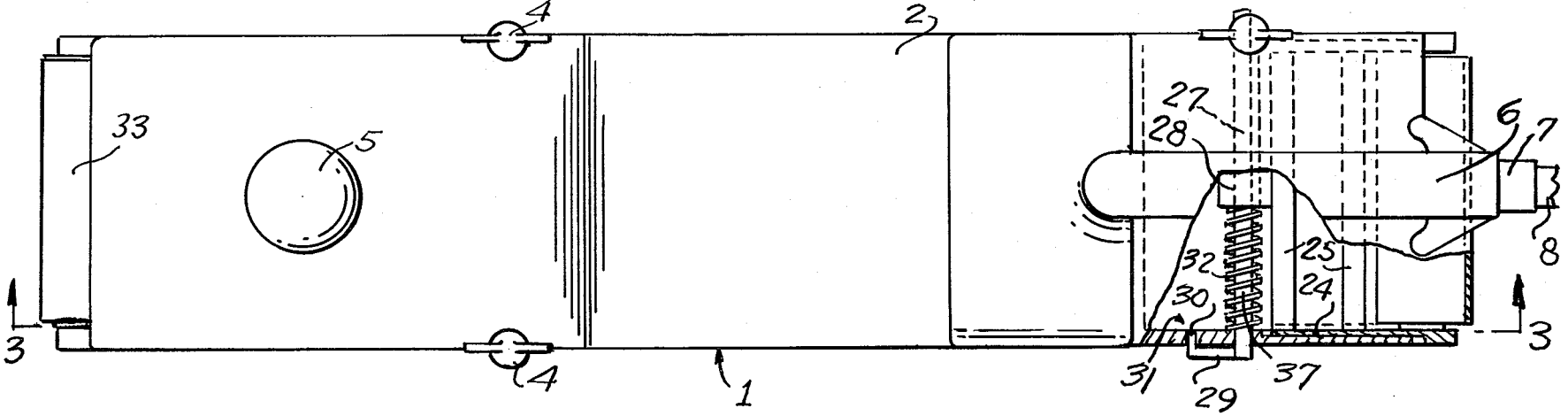
FIG. 1 is a plan view of a first embodiment of sanding tool, with pneumatic motor drive, with parts shown broken away and in section to show details.
Figure 2:
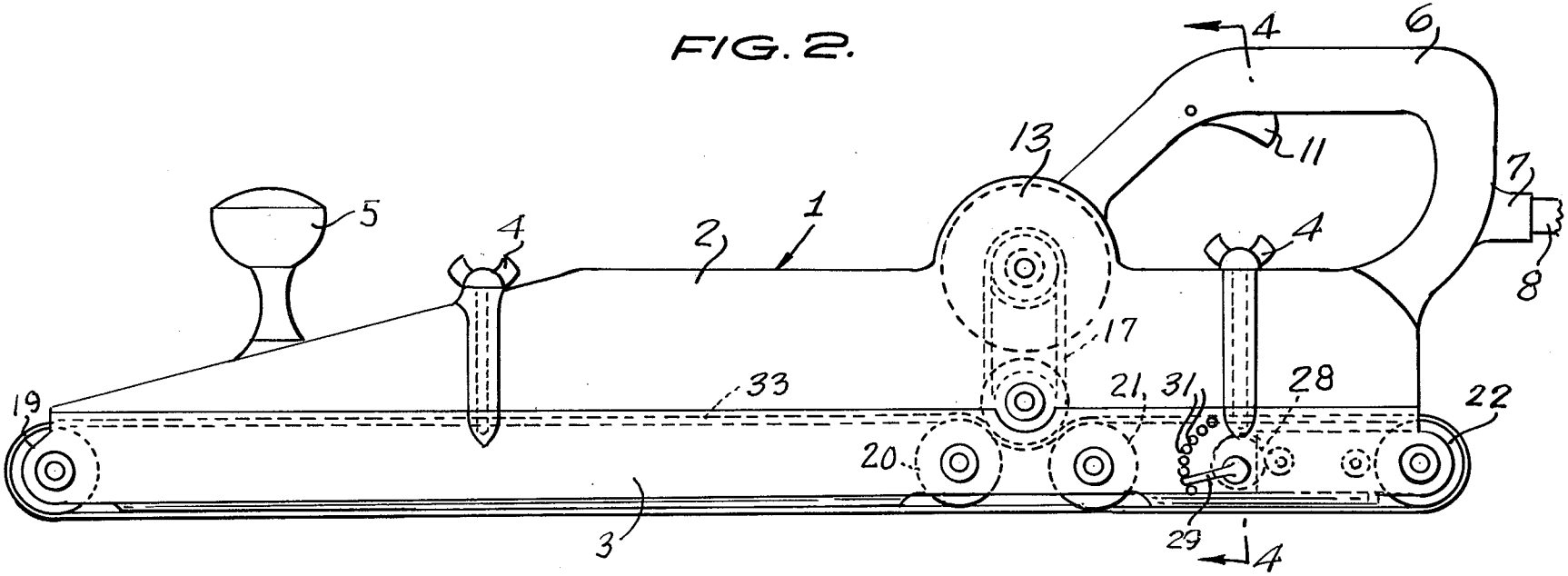
FIG. 2 is a side elevation of the sanding tool of FIG. 1.
Figures 3, 4:
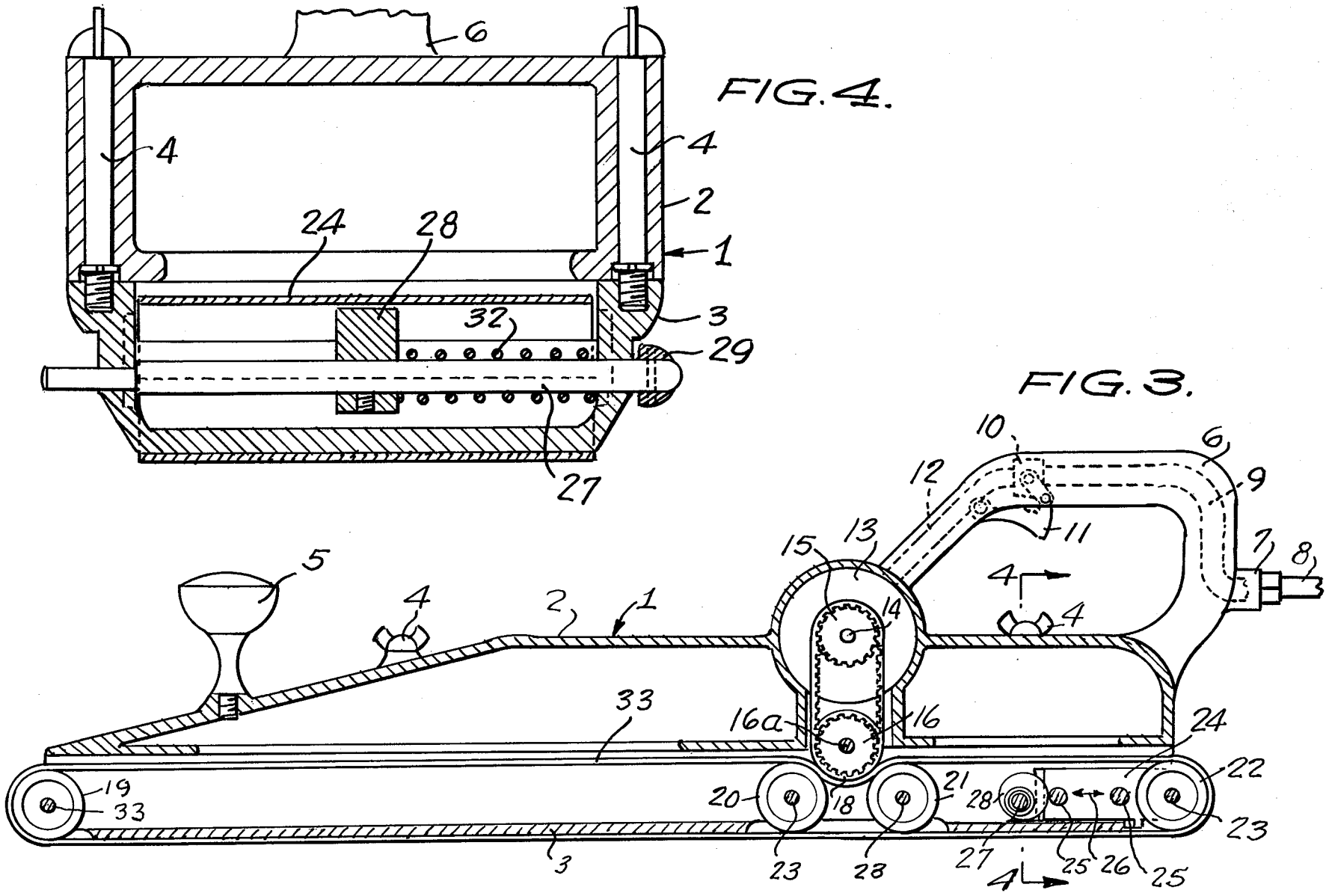
FIG. 3 is a vertical longitudinal section taken on the line 3—3 of FIG. 1.
FIG. 4 is a vertical transverse section taken on the line 4—4 of FIG. 2.

Referring to FIGS. 1 to 4, the sanding tool comprises a body 1 including an upper portion 2 and a lower portion 3 secured releasably together by wing bolts 4. On the upper portion 2 there are provided a front handgrip 5 and a rear handgrip 6. On the rear handgrip 6 there is a bushing 7 receiving a flexible air pipe 8 for supply of compressed air through a conduit 9 to a control valve 10 operable by a pivoted trigger 11. From the valve 10 a conduit 12 leads to a pneumatic motor 13 having a drive shaft 14 on which is keyed a sprocket 15 driving a sprocket 16 by means of a chain 17. The sprocket 16 is rotatable on a transverse shaft **16*a* journalled in the upper portion 2 of the body 1 and is coupled to a drive roller 18**.

The lower portion 3 of the body 1 has four rollers 19, 20, 21 and 22, each mounted on a respective shaft 23 for free rotation. Rolllers 19 and 22 are support rollers, and rollers 20 and 21 are thrust rollers. The shafts 23 of the rollers 19, 20 and 21, are mounted in the lower portion 3 of the body. The shaft 23 of the roller 22 is carried on a slide 24 which is guided for movement longitudinally of the body 1 by means of two sets of guide pins 25 arranged in the slide and travelling in respective longitudinal slots. The slide can move in the direction indicated by the arrow 26 in FIG. 3. A transverse shaft 27 is journalled in the lower portion 3 of the body 1 and carries an edge cam 28 which abuts a guide pin 25, such that rotation of the shaft 27 can cause or permit longitudinal movement of the slide 24. At one end of the transverse shaft 27 there is provided, externally of the body a setting lever 29 having an end tooth 30 which can be engaged in any selected one of a number of openings 31, thereby to retain the cam 28 in a selected position of rotation. The transverse shaft 27 can be pulled axially against the pressure of the spring 32 engaged between the body 1 and the cam 28, thereby permitting the tooth 30 to be moved and engaged into another selected opening.

Round the rollers 19 and 22, and running over the rollers 20 and 21, there is provided an endless sanding belt 33, the tension of which is adjustable by means of the cam 28 acting on the slide 24 carrying the end roller 22. At a position between the rollers 20 and 21, the outer sand-covered surface of the belt is engaged partially about the periphery of the drive roller 18 for imparting drive to the belt.

Figure 5:
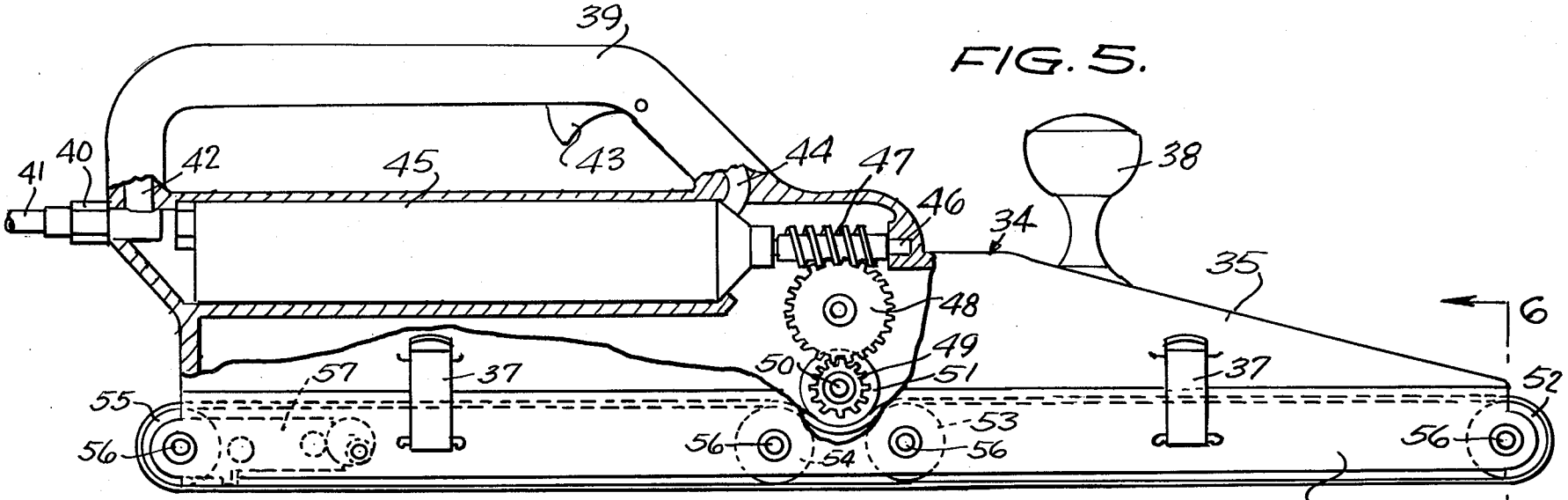
FIG. 5 is a side elevation of a second embodiment of sanding tool, again with pneumatic drive, with parts shown broken away and in section to show details.
Figure 6:
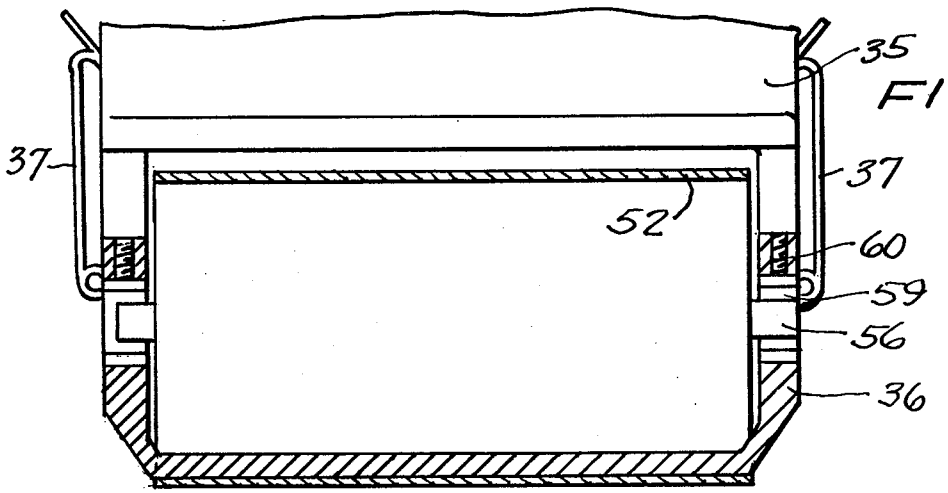
FIG. 6 is a transverse vertical section taken on the line 6—6 of FIG. 5.

Referring now to FIGS. 5 and 6 there is shown a second embodiment of sanding tool having a body 34 with an upper portion 35 and a lower portion 36 secured releasably together by spring snap catches 37. On the upper portion there are provided a front hand grip 38 and a rear hand grip 39. The hand grip 39 has a bushing 40 receiving flexible air piping 41 for a supply of compressed air through a conduit 42 to a control valve (not shown) controlled by a trigger 43. A conduit 44 leads from the air valve to a pneumatic motor 45 having a drive shaft 46 on which is keyed a worm 47 driving a worm wheel 48 meshed with a pinion 49 rotatable on a shaft 50 journalled in the body 1. On the shaft 50 there is mounted a drive roller 51 coupled to the pinion 49.

In the lower portion 36 of the body there are provided four rollers 52, 53, 54 and 55, each freely rotatably and mounted on a respective transverse shaft 56. Rollers 52 and 55 are support rollers, and rollers 53 and 54 are thrust rollers. The transverse shafts 56 of the rollers 52, 53 and 54 are journalled in the lower portion 36 of the body. The transverse shaft 56 of the roller 55 is journalled in a slide 57 which is adjustable longitudinally of the body portion 36 by means of an edge-cam and lever assembly corresponding to the items 27 and 32 described in relation to FIGS. 1 to 4.

About the rollers 52, 53, 54 and 55 there is engaged an endless sanding belt 58 the tension of which can be adjusted by means of the edge-cam and lever assembly. Between the rollers 53 and 54, the belt is engaged partially about the periphery of the drive roller 51. Referring to FIG. 6, the roller 52 has its shaft 56 mounted in plain bearings 59 secured in openings of the lower body portion 36 by means of set screws 60.

Figure 7:
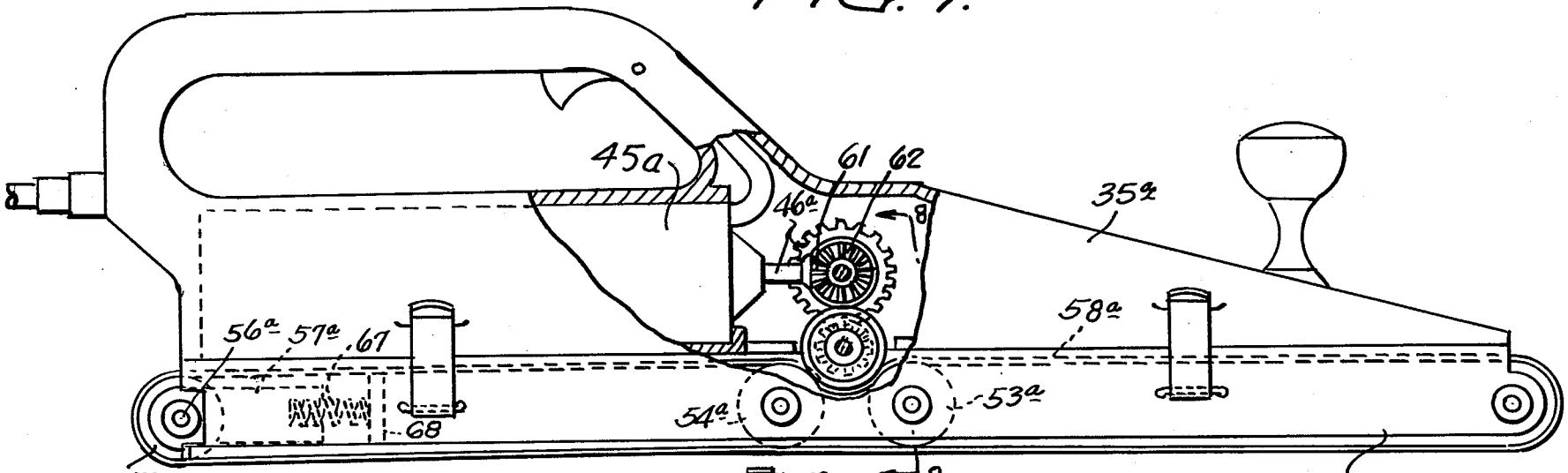
FIG. 7 is a side elevation of a third embodiment of sanding tool, with modified pneumatic drive, with parts shown broken away and in section to show details.
Figure 8:
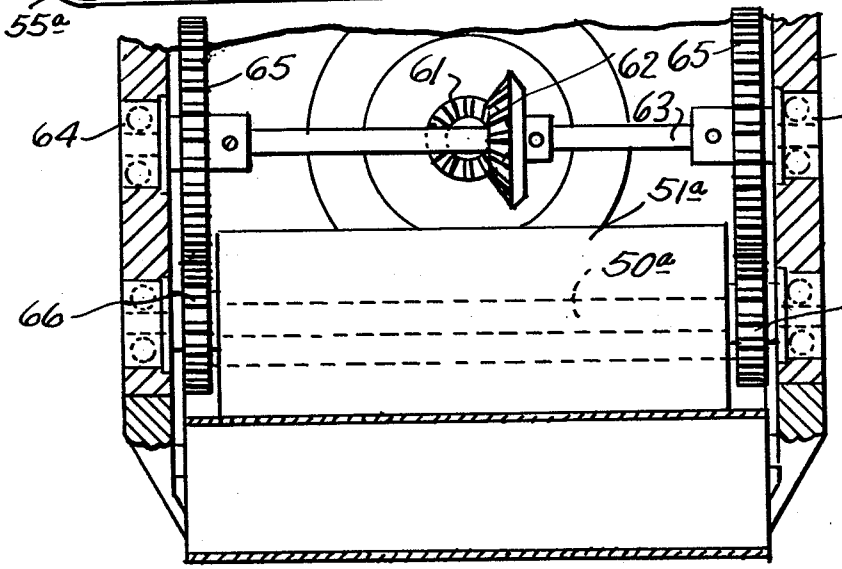
FIG. 8 is a scrap vertical transverse section taken on the line 8—8 of FIG. 7.

Referring now to FIGS. 7 and 8 the sanding tool has a construction which is identical to that described in relation to FIGS. 5 and 6, with the exception of the connection of the drive motor to the drive roller, and the manner of longitudinal adjustment of the end support roller 55*a*. In this construction, the pneumatic drive motor 45*a* is of somewhat larger diameter and has a drive shaft 46*a* on which is keyed a bevel pinion 61 meshed with another bevel pinion 62 keyed on a transverse shaft 63 carried at its end in bearings 64 mounted in the side walls of the upper body portion 35*a*. The shaft 63 has keyed thereon two pinions 65 which mesh with respective pinions 66 keyed on a transverse shaft 50*a* on which is keyed a drive roller 51*a*. The sanding belt 58*a* is engaged partially about the periphery of the drive roller 51*a*, at a position between two thrust rollers 53*a* and 54*a*. The roller 55*a* is mounted on a shaft 56*a* journalled in a slide 57*a* which is slidable longitudinally of the lower portion 36*a* of the body under the influence of a compression spring 67 abutting at one end against the slide and at the other end against a fixed member 68 of the body.

Figure 9:
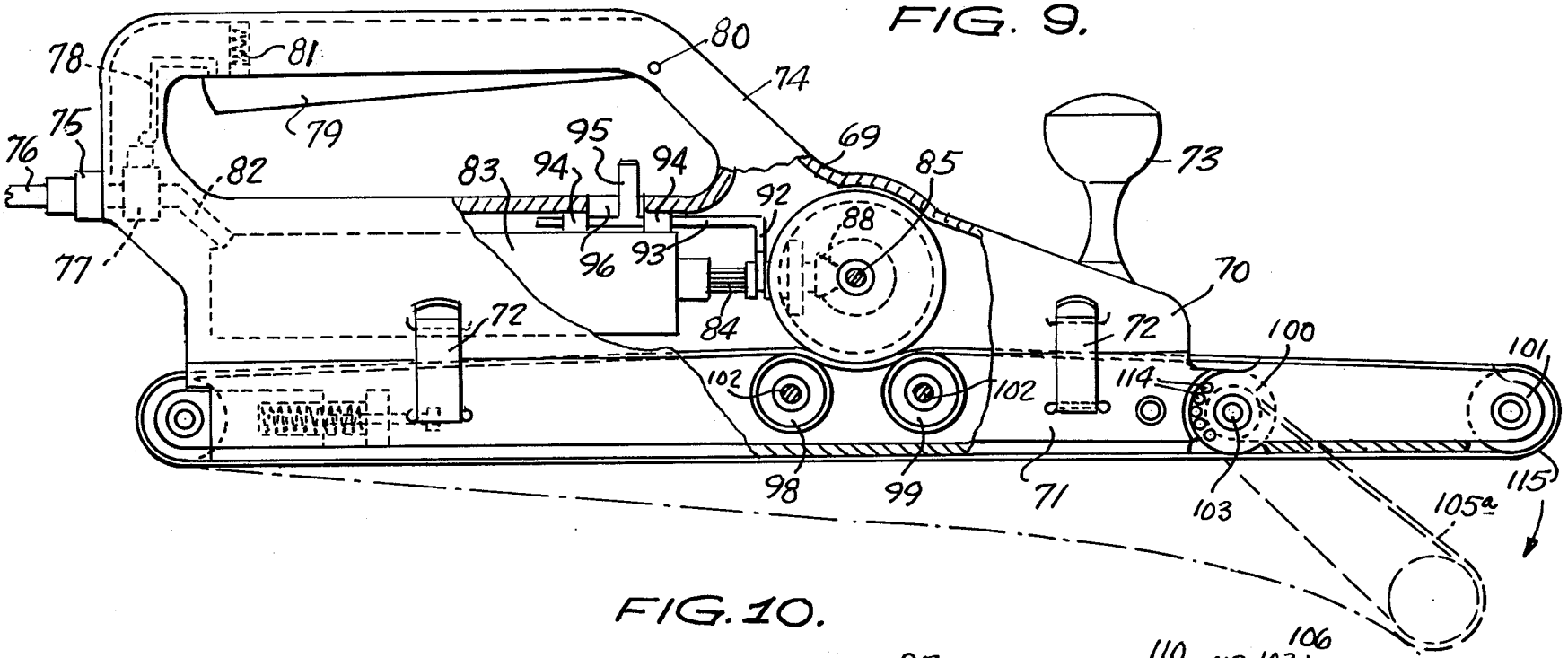
FIG. 9 is a side elevation of a fourth embodiment of sanding tool, with still further modified pneumatic drive, with parts shown broken away and in section to show details.
Figure 10:
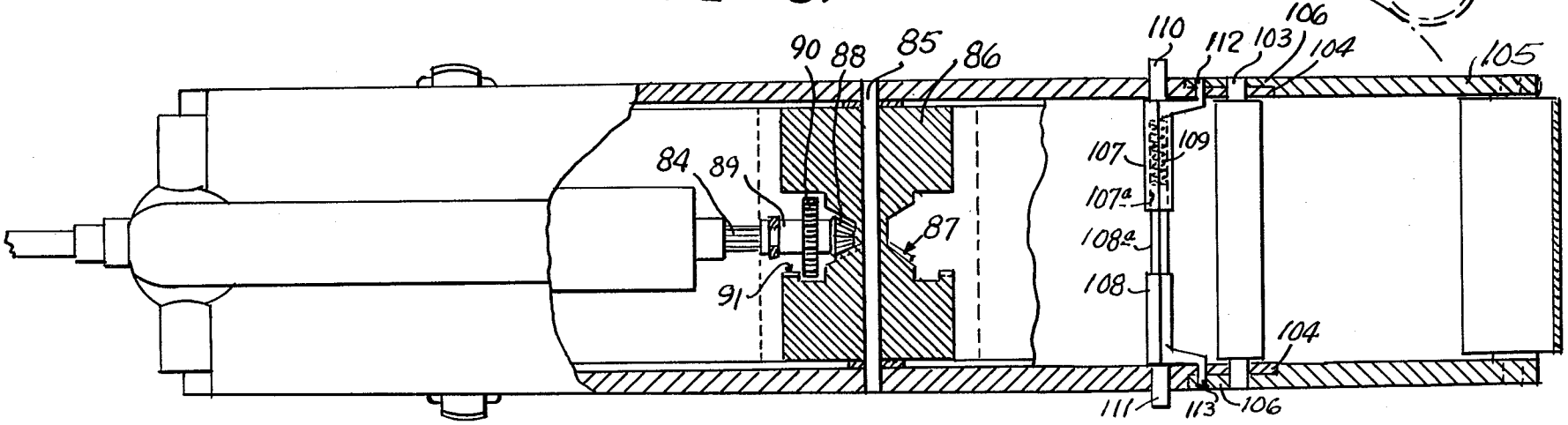
FIG. 10 is a plan view of the embodiment of FIG. 9 with parts shown broken away and in horizontal section to show details.

Referring now to FIGS. 9 and 10 the sanding tool comprises a body 69 having an upper portion 70 and a lower portion 71 secured releasably together by means of spring clips 72. On the upper portion there are provided a front hand grip 73 and a rear hand grip 74. The rear hand grip 74 has a bush 75 receiving a flexible air conduit 76 for supply of compressed air to a control valve 77 which is operable through a linkage 78 by means of a trigger 79 mounted on a pivot 80 and under the influence of a return spring 81. From the valve an air conduit 82 leads to a pneumatic motor 83 having a splined drive shaft 84. In the upper portion 70 of the body there is mounted a transverse shaft 85 on which is freely rotatable a drive roller 86. Centrally the drive roller 86 is provided with a set of bevel teeth 87 which can be engaged by a bevel pinion 88 formed on a sleeve 89 which is internally splined and can slide along the splined drive shaft 84. The sleeve 89 also has a larger pinion 90 which can mesh with an internal gear ring 91 of the drive roller 86. According to the position of longitudinal movement of the sleeve 89, either the gears 87, 88 or the gears 90, 91 will be meshed, thereby permitting selecting of two different drive speeds for the drive roller. The sleeve 89 is shiftable longitudinally by means of a forked end 92 of a speed selector control 93 which is slidable in guides 94 and has a manual push button 95 protruding through an opening 96 to a position adjacent the rear hand grip.

In the lower portion 71 of the body there are provided a rear end support roller 97, two intermediate thrust rollers 98 and 99, and two fore-end support rollers 100 and 101. The rear end roller 97 is mounted freely rotatably in a slide which can move longitudinally of the body under the influence of a loading spring, substantially as described in relation to FIGS. 7 and 8. The two intermediate rollers 98 and 99 are freely rotatably carried on respective transverse shafts 102. The fore-end roller 100 is mounted freely rotatably on a transverse shaft 103 which is journalled in two wings 104 of the body, and a front end extension member 105 has wings 106 which are pivotable on the shaft 103 so as to permit the extension member to assume different angular positions of adjustment, for example as indicated in chain-dotted line at 105*a* in FIG. 9. For locking of the extension member in a selected position of pivoting there is provided a pair of locking elements 107 and 108 which are engaged for axial relative movement by a reduced portion 108*a* slidable in a bore 107*a*, and under the influence of a compression spring 109. The protruding ends 110 and 111 can be pushed in manually so as to cause respective teeth 112 and 113 to be withdrawn from the selected one of a set of openings 114 provided in the wings 106 of the extension member.

About the rollers 97 and 101, and over the rollers 98, 99 and 103 there is engaged an endless sanding belt 115, and between the intermediate rollers 98 and 99 the outer surface of the belt is engaged by the drive roller 86.

Figure 11:
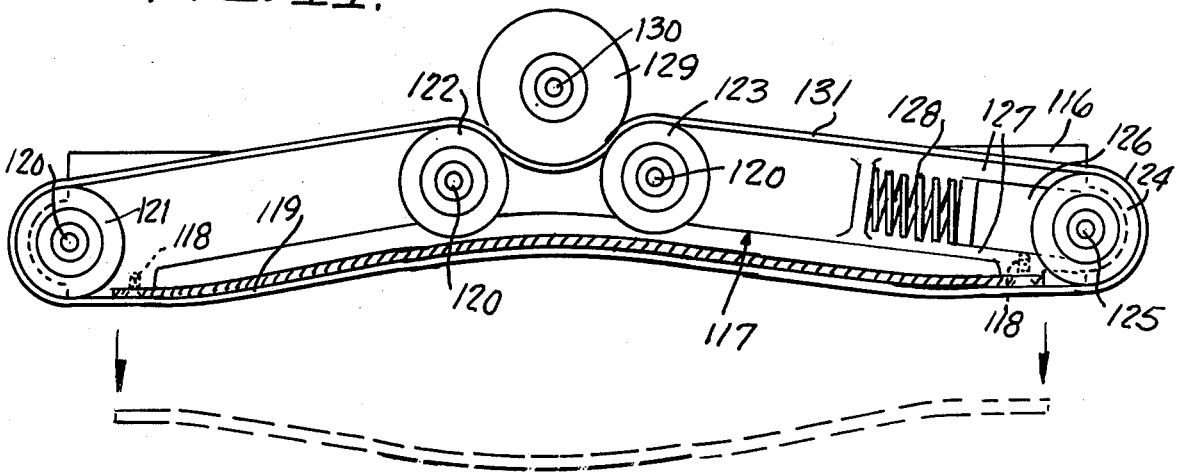
FIG. 11 is a longitudinal schematic view to show details of a fifth embodiment.

Referring to FIG. 11, there is shown a construction of sanding tool which comprises a body 116 having its lower surface concavedly recessed as at 117. Secured over the recessed zone, by screws 118, there is a backing sheet 119 of flexible, or resiliently bendable, material such as nylon-reinforced rubber mat. In the body there are journalled transverse shafts 120 for an end support roller 121 and intermediate thrust rollers 122 and 123. Another end support roller 124 is carried on a transverse shaft 125 mounted in a slide 126 which is guided by arms 127 of the body for longitudinal sliding under the influence of a compression spring 128. A drive roller 129 is keyed on the drive shaft 130 of a pneumatic motor (in this view hidden behind the drive roller) mounted on top of the body 116. About the rollers 121 and 124, and over the rollers 122 and 123, there is engaged an endless sanding belt 131, and between the rollers 122 and 123 the belt is engaged partially about the periphery of the drive roller.

Figure 12:
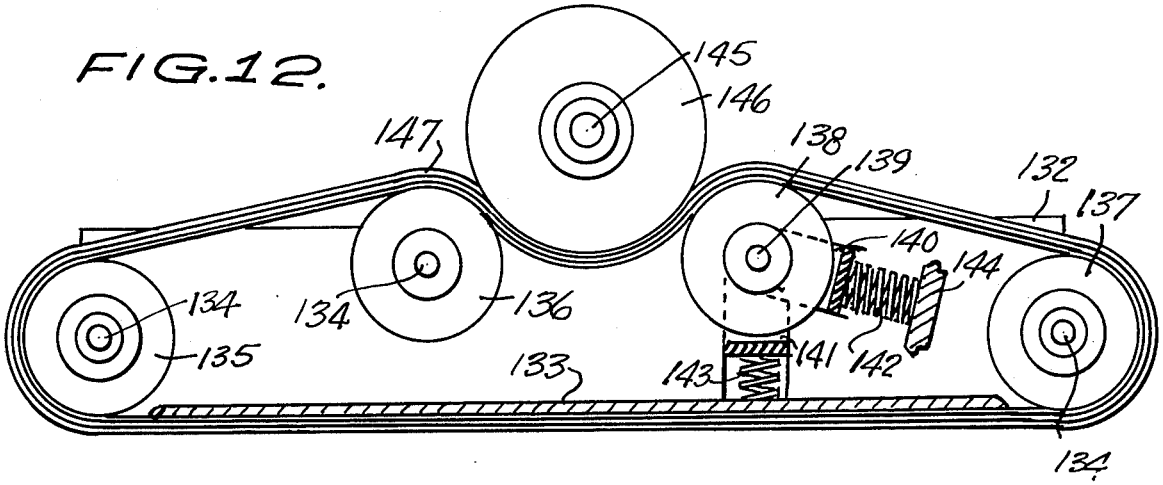
FIG. 12 is a central vertical longitudinal section of a sixth embodiment of sanding tool.

Referring now to FIG. 12, the sanding tool has a body 132 including a rigid lower wall 133. In the body 132 there are journalled transverse shafts 134 for support roller 135, thrust roller 136, and support roller 137. A thrust roller 138 is mounted on a shaft 139 which is carried by two links 140 and 141 which are under the influence of respective compression springs 142 and 143 urging the shaft 139 away from a body wall 144 and the body wall 133. On the top of the body 132 there is mounted a pneumatic motor (in this view hidden behind the drive roller) having a drive shaft 145 on which is keyed a drive roller 146. A plurality of endless sanding belts 147 is engaged about the rollers 135 and 137 and over the rollers 136 and 138, and between the latter the bunch of belts passes partially about the periphery of the drive roller. As a belt wears away, or is removed when no longer useful, the roller 138 moves upwardly and towards the drive roller 146 to main the remainder of the bunch of belts under suitable tension.

Figure 13:
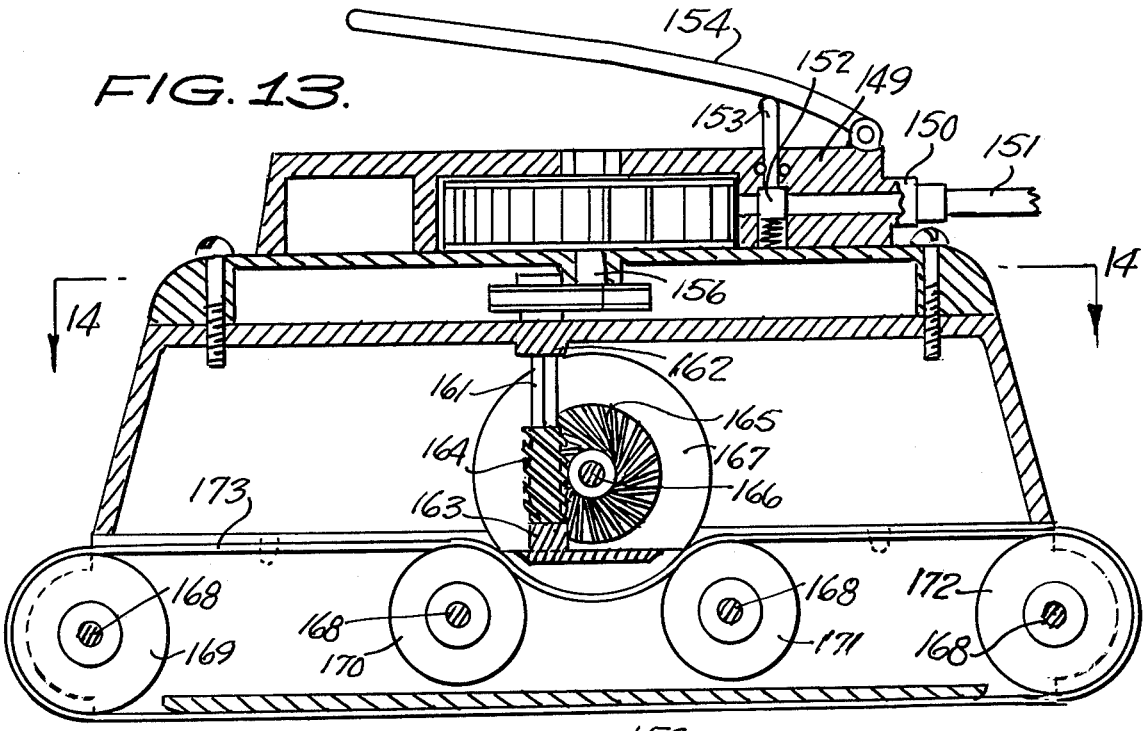
FIG. 13 is a central longitudinal vertical section of a seventh embodiment of sanding tool.
Figure 14:
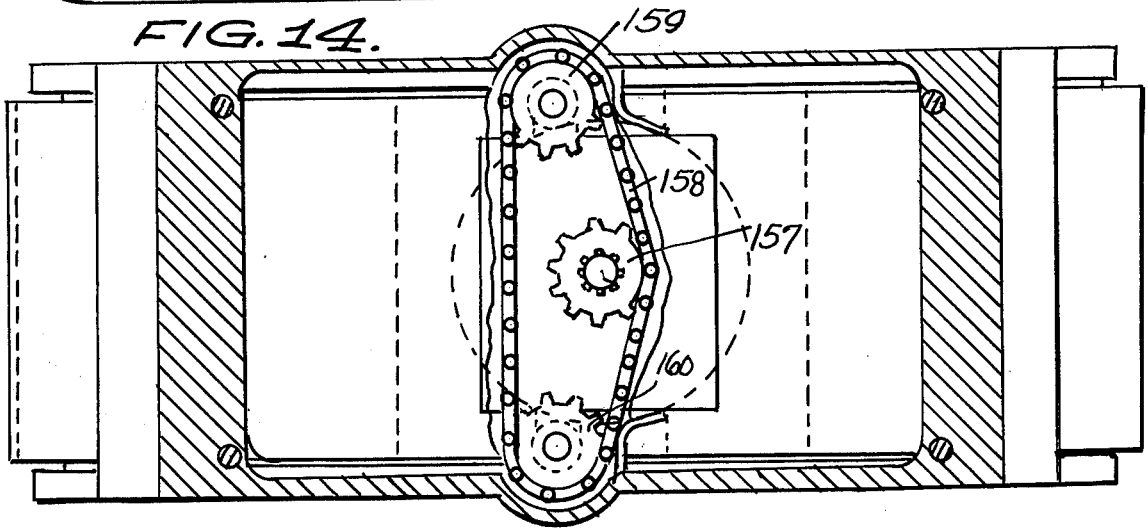
FIG. 14 is a horizontal section taken on the line 14—14 of FIG. 13.

Referring now to FIGS. 13 and 14, the sanding tool comprises a body 148 having at its upper part a separable housing 149 with a bushing 150 receiving a flexible air hose 151 for feeding compressed air to a control valve 152 having an actuating element 153 which can be moved by a trigger 154. Air is fed to a turbine wheel 155 keyed on a shaft 156 journalled in the body and splined to carry an internally splined sprocket 157 which drives a chain 158 passed about sprockets 159 and 160 each carried on a respective vertical shaft 161 rotatable in bearing 162, 163 of the body. On each shaft 161 there is keyed a helical pinion 164 meshing with an associated offset crown wheel 165 keyed on a common transverse shaft 166 on which is keyed a drive roller 167. In the lower part of the body 148 there are journalled respective transverse shafts 168 for support rollers 169 and 172, and for thrust rollers 170 and 171. An endless sanding belt 173 is engaged about the end rollers 169 and 172, and over the rollers 170 and 171. Between the latter the belt is engaged partially about the periphery of the drive roller 167.

Figure 15:
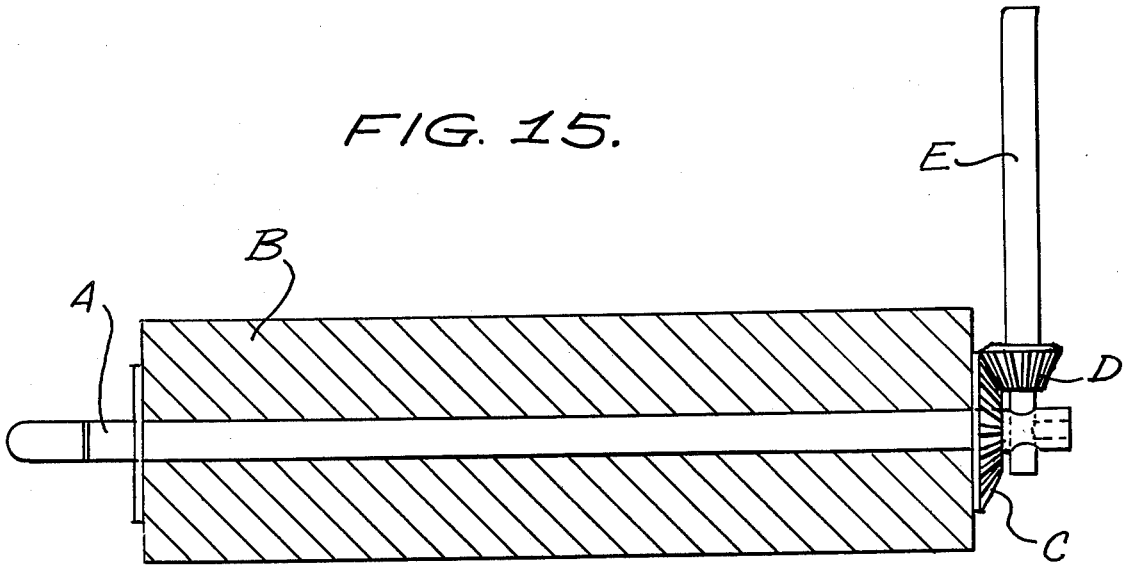
FIG. 15 is a schematic elevation of a right-angle drive for a drive roller.
Figure 16:
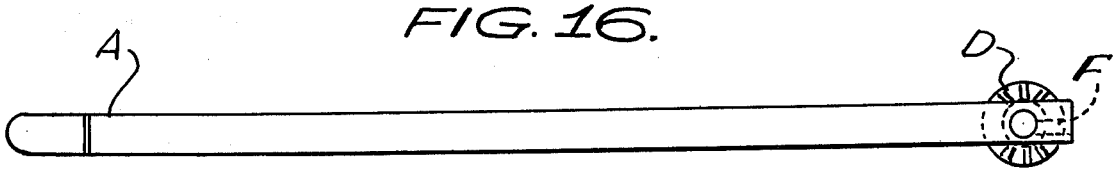
FIG. 16 is a schematic plan view of the right-angle drive of FIG. 15.

FIGS. 15 and 16 show a detail of a modification which may be applied to any of the embodiments above described, for the purpose of permitting rotation of the drive roller by power obtained from an external appliance, such as an electric drill, instead of from an inbuilt motor. In each case the drive roller is mounted on a transverse shaft in the body of the tool. If the shaft "A" of FIGS. 15 and 16 is assumed to represent said transverse shaft, and is stationary, and "B" represents the drive roller freely rotatable thereon, the roller can be driven from an external source by the provision of a bevel pinion "C" secured to the roller and meshing with another bevel pinion "D" carried on a shaft "E." The shaft "E" would be arranged to protrude from the body of the tool, for engagement of any suitable external drive means, e.g., the chuck of a conventional electric drill. The shaft "E" is retained in position by providing it with a circumferential recess, near to its end adjacent to the pinion "D," into which there is engaged the end of a set screw "F" threaded into the shaft "A."

Reference is made throughout this specification and the appended claims to a sanding tool, but the invention is not restricted to use of sanding belts, and any other abrasive-bearing flexible looped belt having the abrasive at least on the outer surface is included within the scope of the appended claims.

In the specification and in the appended claims, reference is made to (i) support means, and (ii) two thrust means. It is specifically pointed out that these are not necessarily separate integers. The thrust means, that is one or both of them, may be constituted by a support means. For example, the belt may be looped only about two end rollers, with the drive roller contacting the belt between the end rollers, and in such a case the end rollers constitute both the support means and the thrust means. Again, the thrust means could be constituted by one such end roller, and a single thrust roller, with the drive roller contacting the belt between that end roller and that thrust roller.

An essential of the invention is that there shall be at least some extent of angular "wrap-around" of the belt about the periphery of the drive roller, i.e., that the periphery of the drive roller extends, in the direction towards the other remote run of the belt loop, beyond a common plane tangential to the thrust rollers at the arcuate zone over which they are contacted by the nearer run of the belt loop.

The invention has been described and illustrated in the foregoing specification and in the accompanying drawings in several embodiments, which are not limiting of the invention. It will be apparent to those skilled in the art of construction of sanding tools that various modifications may be made therein, and that features of each embodiment may be transferable, where the context allows, to each other embodiment, within the scope of the appended claims.

I claim:

1. An endless belt sanding tool comprising:

(i) a body, (ii) support means at spaced positions on said body, (iii) two thrust means at spaced positions on said body between said support means and having a common tangential plane, (iv) an endless sanding belt engaged for returning about said support means and engaged over said thrust means, and (v) a driving roller journalled for rotation on said body and positioned with a peripheral portion thereof extending between said thrust means beyond said common tangential plane, to be contacted over an arc by the external face of a run of said belt intermediate the portions of the belt engaged over said thrust means.

2. An endless belt sanding tool, as claimed in claim 1, comprising a motor on said body, and means coupling said motor to said driving roller.

3. An endless belt sanding tool, as claimed in claim 1, wherein said body comprises separable first and second portions, and means for securing said first and second portions releasably together, said support means and said thrust means being on said first body portion, said driving roller being on said second body portion.

4. An endless belt sanding tool, as claimed in claim 1, wherein said support means comprises a first support and a second support relatively movable on said body in a direction to slacken and tighten the belt.

5. An endless belt sanding tool, as claimed in claim 4, wherein said first support is mounted stationarily on said body, and wherein said second support is mounted on a carrier slideably mounted on said body for movement longitudinally of said body and a cam rotatably mounted on said body and engaging said carrier for adjusting the position thereof.

6. An endless belt sanding tool, as claimed in claim 4, wherein said first support is mounted stationarily on said body, and wherein said second support is mounted on a carrier under spring-loading.

7. An endless belt sanding tool, as claimed in claim 2, wherein said coupling means includes a selectable change-speed device.

8. An endless belt sanding tool, as claimed in claim 1, wherein said body includes an extension member carrying one said support means, said extension member being pivotable about an axis, parallel to the axis of rotation of the drive roller, with respect to the remainder of the body, and wherein means are provided for locking said extension member in any selected position of pivoting with respect to the remainder of the body.

9. An endless belt sanding machine, as claimed in claim 1, wherein said body includes a recess, and a resiliently deformable backing sheet secured over said recess and within the closed loop of the sanding belt.

10. An endless belt sanding machine, as claimed in claim 1, wherein said endless belt comprises a plurality of discrete belts arranged in a bunch, and wherein one of said thrust means is movably mounted on said body under the action of spring-loading urging said thrust means in a direction to maintain tension in said bunch of belts.

* * * * *